US007538079B2

(12) United States Patent
Warr et al.

(10) Patent No.: US 7,538,079 B2
(45) Date of Patent: May 26, 2009

(54) SPRAY DRIED POWDERED DETERGENTS WITH PERFUME-CONTAINING CAPSULES

(75) Inventors: Jonathan Warr, Paris (FR); Stuart Fraser, Paris (FR); Emmanuel Aussant, Paris (FR)

(73) Assignee: Takasago International Corporation, Tokyo (JP)

( * ) Notice: Subject to any disclaimer, the term of this patent is extended or adjusted under 35 U.S.C. 154(b) by 52 days.

(21) Appl. No.: 11/525,048

(22) Filed: Sep. 22, 2006

(65) Prior Publication Data

US 2007/0149423 A1 Jun. 28, 2007

(30) Foreign Application Priority Data

Sep. 23, 2005 (EP) ..... 05291975

(51) Int. Cl.
*C11D 17/06* (2006.01)

(52) U.S. Cl. ..... 510/445; 510/438; 510/452; 510/475; 510/101; 510/300; 252/132

(58) Field of Classification Search ..... 510/101, 510/300, 445, 475
See application file for complete search history.

(56) References Cited

U.S. PATENT DOCUMENTS

| | | | | |
|---|---|---|---|---|
| 4,145,184 | A | 3/1979 | Brain et al. | 8/137 |
| 4,234,627 | A | 11/1980 | Schilling | 427/242 |
| 4,511,495 | A | 4/1985 | Melville | 252/522 |
| 5,188,753 | A * | 2/1993 | Schmidt et al. | 510/395 |
| 5,324,444 | A | 6/1994 | Berry et al. | 252/174.11 |
| 5,500,154 | A | 3/1996 | Bacon et al. | 252/551 |
| 5,554,588 | A | 9/1996 | Behan et al. | 512/1 |
| 5,596,051 | A * | 1/1997 | Jahns et al. | 526/73 |
| 5,726,345 | A | 3/1998 | Paget et al. | 560/238 |
| 6,218,355 | B1 | 4/2001 | Herrmann | 512/27 |
| 6,458,754 | B1 * | 10/2002 | Velazquez et al. | 510/441 |
| 6,608,017 | B1 * | 8/2003 | Dihora et al. | 510/349 |
| 6,849,591 | B1 | 2/2005 | Boeckh et al. | 510/475 |
| 6,869,923 | B1 * | 3/2005 | Cunningham et al. | 512/4 |
| 2003/0125222 | A1 * | 7/2003 | Jahns et al. | 510/130 |

FOREIGN PATENT DOCUMENTS

| | | | |
|---|---|---|---|
| EP | 05 291 976.8 | | 9/2005 |
| WO | WO 93/13195 | | 7/1993 |
| WO | WO 03/035245 | * | 5/2003 |
| WO | WO 2005/059083 | | 6/2005 |

* cited by examiner

*Primary Examiner*—Mark Eashoo
*Assistant Examiner*—Jane L Stanley
(74) *Attorney, Agent, or Firm*—Fitzpatrick, Cella, Harper & Scinto

(57) ABSTRACT

The present invention relates to a process for the manufacture of a spray dried powder comprising:

(a) forming a warm, stirred aqueous slurry comprising: inorganic salts, at least one binding agent and 0.001 to 20% by weight of capsules based on the weight of spray dried powder, said capsules containing benefit agents including at least perfume, and (b) spray drying the resultant slurry to form a spray dried powder, said capsules being such that:

1) more than 40% of the benefit agents remain encapsulated 60 minutes after dispersion thereof at 70° C. in the slurry as defined in the "slurry survival test" in a sealed vessel without agitation; and 2) more than 30% of the benefit agents added for 15 minutes to an ambient slurry as defined in the "spray dry test" survive spray drying through a laboratory scale spray drier.

18 Claims, No Drawings

SPRAY DRIED POWDERED DETERGENTS WITH PERFUME-CONTAINING CAPSULES

FIELD OF THE INVENTION

The present invention relates to a process for spray drying an oil or waxy solid containing aminoplast core shell capsule along with inorganic salts and optionally a binding agent or one or more surfactants to form a particulate powder.

BACKGROUND OF THE INVENTION

Textile laundering is increasingly concerned with the delivery of benefits as well as cleaning. A long lasting fragrance on the dried laundry is one such benefit others include malodour counteractants as illustrated in U.S. Pat. No. 5,554,588, aromatherapy agents, chemaesthetic agents etc. Unfortunately it is technically difficult to achieve both a high degree of cleaning and delivery of small organic molecules to a surface simultaneously as can be seen from the various means which have been attempted to deliver a long lasting fragrance from a laundry cleaning process, e.g. in U.S. Pat. No. 5,500,154. Not only are fragrance ingredients susceptible to reaction with other ingredients in the detergents, they can also be solubilised by surfactant and so lost from the wash. Furthermore volatile materials such as fragrances can evaporate as the laundry dries. Whilst it may be beneficial to generate a noticeable fragrance during the laundering process and while drying, the loss of perfume usually means that comparatively little fragrance remains on the dried laundry.

Adding fragrance during later stages of the laundry process is one way to provide fragrance to the laundry e.g. through rinse conditioners or drier sheets as shown in U.S. Pat. No. 4,511,495 and ironing products but this involves the cost and inconvenience of purchasing and using an additional product. Another method for delivering perfume to laundered fabric is one which increases deposition during the wash and prevents evaporation during drying for example by the use of pro-fragrances. These molecules deposit onto textiles during the wash and later react to release volatile fragrance molecules. The reaction can be triggered by a number of means: under the influence of co-deposited enzymes as in U.S. Pat. No. 5,726,345, of sunlight as in U.S. Pat. No. 6,218,355, or by bacterial or enzymatic decomposition. Such technology is successful but is limited to a relatively small range of fragrance materials which can be used to synthesis pro-fragrances and that the resulting odour cannot comprise the mixture of molecules that generally comprise a full fragrance. A more promising approach has been to encapsulate the fragrance. U.S. Pat. Nos. 4,145,184 and 4,234,627 teach using a capsule with an outer coating which prevents diffusion of the perfume through the capsule wall. The capsules deposit on the fabrics during laundering and open to release their contents as occurs during fabric manipulation. However there are several practical difficulties to be overcome to make this technology work commercially. One of the major difficulties has been to dose the capsules in such a way that they do not separate within the packet of powder because of particle size differences. Also the capsules must be sufficiently robust to withstand all the processes involved in manufacture e.g. transporting, handling and packing yet still be sufficiently friable as to rupture under relatively gentle conditions whilst handling the garment. Thus, it would be desirable to provide a means of protecting a wide range of perfumery materials during prolonged storage in the detergent. For example certain fragrance components are sensitive to the alkalinity and/or bleach content of detergent powders.

It would be desirable to provide a method for delivering a broad range of perfumery ingredients to laundry from a detergent product during the laundry process.

It would be desirable to provide a long lasting fragrance to dried laundry.

It would be desirable to reduce the amount of post tower addition of perfume oil for laundry detergents, which can lead to poor powder properties, and sometimes overly intense fragrance.

It would be even more desirable that any capsule intended to provide the benefits stated above could be in a form so as to mix easily and uniformly in a detergent powder and withstand processing and manipulation during manufacture and yet be capable of rupturing on handling the laundry.

SUMMARY OF THE INVENTION

The present invention relates to the process of manufacturing powders containing perfume capsules by spray drying.

The process involves (a) the preparation of a slurry which contains inorganic salts and optionally a binding agent and between 0.001% and 20% by weight based on the dried powder of the capsules and (b) spray drying the resulting slurry to form a spray dried powder.

A preferred form of the invention is that the powder is a laundry detergent powder in which case the slurry may contain at least one detergent active of the type anionic, non-ionic, zwitterionic or cationic surfactant. Part of the inorganic salts may function as the builder in the detergent as for example with phosphate or carbonate salts. Alternatively the slurry might include additional inorganic compounds such as aluminosilicate salts which function as a detergent builder. Other common ingredients of detergent powders normally added to the slurry indude fluorescers, polymers such as maleic anhydride acrylic acid copolymers, sequestrants, silicone antifoams, and anti redeposition agents.

The invention also covers any subsequent treatment of that powder necessary to prepare particles which can be incorporated directly into a laundry detergent product. So, depending on the design and operation of individual spray drying towers, granulation may be required to form particles of the appropriate size for inclusion into a detergent powder. Such granulation may be part of the same spray drying process or a separate step after the spray drying.

Whilst it is envisaged that the powder of the invention could be used directly in laundry cleaning or conditioning, it could be blended with other ingredients typically post-dosed into spray dried detergents such as bleaches, bleach precursors, sequestrants, enzymes, colour protecting agents, further surfactants, inorganics, and fragrance as part of the detergent manufacturing process. Furthermore the capsules of the invention could be added to a detergent powder as a convenient way of adding concentrated encapsulated perfume into another pre-formed detergent powder. Alternatively the powder might be converted into another form of detergent product for example the powder might be compressed or coated to form a detergent tablet which is then used for fabric treatment as part of conventional laundering.

The use of dispersants is often advantageous for tablets.

Preferably, the capsules used in the invention process have an average particle size of less than about 300 microns preferably an average size of not greater than 100 microns and especially a 5-50 micron average size range.

Advantageously, the capsules used in the invention process are core shell capsules which are thermally stable at 250° C. for 15 minutes.

Namely, the present invention relates to the following (1) to (12).

(1) A process for the manufacture of a spray dried powder comprising:

(a) forming a warm, stirred aqueous slurry comprising: inorganic salts, at least one binding agent and 0.001 to 20% by weight of capsules based on the weight of spray dried powder, said capsules containing benefit agents induding at least perfume, and (b) spray drying the resultant slurry to form a spray dried powder, said capsules being such that:

1) more than 40% by weight of the benefit agents remain encapsulated 60 minutes after dispersion thereof at 70° C. in the slurry as defined in the "slurry survival test" in a sealed vessel without agitation; and 2) more than 30% by weight of the benefit agents added for 15 minutes to an ambient slurry as defined in the "spray dry test" survive spray drying through a laboratory scale spray drier.

(2) The process according to (1) above, wherein the slurry is a slurry for detergent powder, said slurry containing at least one builder as inorganic salt, at least one surfactant as binding agent and optional other detergent powder ingredients.

(3) The process according to (2) above, wherein the slurry for detergent powder further contains a zeolite, phosphate or carbonate builder, or a combination thereof.

(4) The process according to (1) above, wherein the capsules are core shell capsules containing in the core an oil or waxy solid, said oil or waxy solid containing less than 20% by weight of aldehydes.

(5) The process according (1) above, wherein the capsules are core shell capsules containing in the core an oil or waxy solid, said oil or waxy solid containing less than 10% of primary or secondary amines.

(6) The process according to (1) above, wherein the capsules are core shell capsules containing in the core an oil or waxy solid, more than 80% by weight of said oil or waxy solid having a ClogP in the range of 1.5-4.5, preferably in the range of 2-4.

(7) The process according to (1), wherein the capsules are core shell capsules containing in the core an oil or waxy solid, said oil or waxy solid comprising:

(1) 50-100%, preferably 60-100%, more preferably 70-100%, and even more preferably 80-100% by weight of a perfume composition, which is a mixture of at least two perfume ingredients selected from:

(a) aldehydes, including alpha beta unsaturated aldehydes, which constitute 0-20%, preferably 0-10%, more preferably 0-5% and even more preferably 0-1% by weight of the perfume composition;

(b) primary or secondary amines constituting 0-10%, preferably 0-1% by weight of the perfume composition;

(c) perfume ingredients having a ClogP>4.0, which constitute 0-25%, preferably 0-20% by weight of the perfume composition;

(d) perfume ingredients having a ClogP>5.0, which constitute 0-20%, preferably 0-15% by weight of the perfume composition; and (e) perfume ingredients having a ClogP<2.0, which constitute 0-20% and preferably 0-10% by weight of the perfume composition, and (2) 0-50%, preferably 0-40%, more preferably 0-30% and even more preferably 0-20% by weight of benefit agents other than the perfume ingredients.

(8) The process according to (1) above, wherein the capsule is a core shell capsule wherein the shell comprises formaldehyde-melamine, formaldehyde-melamine-urea, formaldehyde-urea condensation polymer or partially etherified formaldehyde condensation polymers, preferably as the methyl ethers.

(9) The process according to (1) above, wherein the capsule is a core shell capsule which is thermally stable at 250° C. for 15 minutes and contains perfume ingredients and optional other benefit agents such as malodour counteracting agents, essential oils, aromatherapeutic materials, chemaesthetic agents vitamins and insect repellents.

(10) The process according to (1) above, wherein the capsules have a particle size of less than 300 μm, preferably less than 100 μm and most preferably from 5 to 50 μm.

(11) The process according to (1) above, wherein the benefit agent contains 0 to 20% by weight of materials having a ClopP equal or less than 2.

(12) A method for delivering perfume to a laundry, which comprises treating the laundry with a spray dried powder produced by the process according to (1) above.

DETAILED DESCRIPTION OF THE INVENTION

Core Shell Capsule

The majority of laundry detergent and cleaning product compositions contain a perfume in order to give the compositions themselves or textiles treated with them a pleasant fragrance. Some perfumes include compounds which are more or less sensitive to the other chemical constituents. Moreover much of the perfume is solubilised by the surfactant and discarded without depositing onto the laundry. Yet more perfume is lost by evaporation as the laundry dries. To overcome these several problems it has already been proposed to incorporate the fragrances or perfumes in encapsulated form into the laundry detergents or cleaning products. As there are several different problems to be overcome many different types of capsules are proposed as solutions.

Capsules based on starches or water soluble polymers are primarily intended to protect the perfume during storage and to release the perfume once mixed with water as exemplified in EP patent 1,388,585 which releases perfume during the laundering process. Similarly EP patent 1,196,533 which provides an oil or waxy solid encapsulated within a starch capsule will also release it on contact with water. These capsules fail the slurry stability test described below and so are outside the scope of the present invention. Capsules based on perfume incorporation into high melting waxes or polymers such as in EP patent 0,469,228 which claims a perfume solid composition having melting points over the range of 35 to 120° C. are unlikely to retain perfume through the high temperatures of spray drying.

A specific requirement of capsules of the present invention is that a large proportion of the capsules must survive dispersal in the warm aqueous slurry without excessive leakage of the contents and then remain intact through the exposure to high temperatures encountered during spray drying.

Thus, suitable capsules can be defined by two tests:

Slurry Survival Test (Test 1): More than 40% by weight of the encapsulated material must remain encapsulated after 60 minutes once dispersed in the slurry at 70° C. in a sealed vessel without further agitation, the slurry having the following composition:

0.8% 7EO $C_{12}$-$C_{13}$ non-ionic, for example Neodol 23-7 (Shell)

19.7% Molecular sieve, 4 Å, powder, activated (of the type Zeolite 4 Å)

20.5% sodium sulphate 3.0% random acrylic acid/maleic acid copolymer with a molecular weight around 70000, for example the copolymer CP5 Sokalan (BASF)

7.4% Sodium dodecyl benzene sulphonate 0.6% dispersion of encapsulated fragrance and benefit agent 48% water.

The amount of encapsulated material released being determined by an appropriate analytical method, so for example, perfume release might be determined by trapping the released perfume and measuring it by gas chromatography.

Spray Dry Test (Test 2): To meet the requirements of the invention more than 30% by weight of the encapsulated material, added to a slurry at room temperature for 15 minutes, the slurry having the following composition:

0.48% 7EO $C_{12}$-$C_{13}$ non-ionic, for example Neodol 23-7 (Shell)

11.4% Molecular sieve, 4A, powder, activated (of the type Zeolite 4A)

11.4% sodium sulphate 2.0% of a 40% aqueous solution of random acrylic acid/maleic acid copolymer with a molecular weight around 70000, for example the copolymer CP5 Sokalan (BASF)

4.2% Sodium dodecyl benzene sulphonate 0.5% aqueous dispersion of encapsulated fragrance and benefit agent, containing approximately 45% by weight capsules 70.0% water must be present (still encapsulated) after spray drying through a laboratory scale spray drier, for example of the type manufactured by Buchii as the mini spray drier B-290 with the spray nozzle part No 44698. This nozzle has a hole of 0.7 mm diameter, and liquid supplied via a peristaltic pump (rate approximately 560 g/hour of slurry) is mixed with compressed air at 6-8 bar. The resultant droplet size is around 25 μm, and this is dried with hot dry air in a co-current flow, with an inlet temperature of 145-150° C., and an outlet temperature of 55-60° C. The dry powder particles that result are 5-20 μm in diameter. The amount of encapsulated material released from the dry particles can be measured by extraction of powder samples and quantitative analysis of the fragrance.

For the purpose of the invention the core shell capsules based on formaldehyde and urea, formaldehyde and melamine, or formaldehyde and urea and melamine condensation polymers are particularly well suited although this is not intended to exclude capsules made with other monomers or incorporating other monomers or other amine aldehyde condensation polymers. Other suitable monomers for core shell capsules are for example methyl methacrylate as exemplified in International application WO 01/49817, and urethanes as exemplified in International application WO 03/099005. Suitable monomers are well known to those skilled in the art of polymerisation reactions.

There are numerous patents teaching the application of such capsules to encapsulate water insoluble materials often perfume and to deliver these from laundry powders such as U.S. Pat. No. 5,188,753 which discloses a detergent composition comprising surface-active substances and perfume particles containing a perfume dispersed in a solid core of polyethylene, polyamide, polystyrene or the like, the particles being encapsulated within a friable coating made, for example, of urea-formaldehyde resins. When exposed to mechanical force, the capsules fracture and release the enclosed perfume. International application WO 02/74430 describes a modified aminoplast capsule which reduces perfume leakage from the capsule. International application WO 92/18601 teaches the use of aminoplast capsules for laundry application, among others, with the capsules having a core which solidifies at ambient temperature to improve the strength of the capsules. International application WO 00/05951 describes an aminoplast capsule with a base cleavable ester moiety to trigger release under alkaline conditions. However none of the above describes the incorporation of the capsules into spray dried particles. U.S. Pat. No. 6,849,591 teaches the use of spray drying to dry aminoplast capsules but does not suggest the addition of capsules to a detergent slurry, nor the addition of any other ingredients during the drying step.

Particularly preferred core shell capsules suitable for the process of the invention are the core shell capsules containing in the core an oil or waxy solid, said oil or solid waxy having little or no aldehyde or amine containing raw materials. It is also preferable if more than 80% by weight of the oil or waxy solid has a ClogP in the range of 1.5-4.5, more preferably in the range of 2-4.

More preferably, the appropriate core shell capsules contain in the core an oil or waxy solid, said oil or waxy solid comprising:

(1) 50-100%, preferably 60-100%, more preferably 70-100%, and even more preferably 80-100% by weight of a perfume composition, which is a mixture of at least two perfume ingredients selected from:

(a) aldehydes, including alpha beta unsaturated aldehydes, which constitute 0-20%, preferably 0-10%, more preferably 0-5% and even more preferably 0-1% by weight of the perfume composition;

(b) primary or secondary amines constituting 0-10%, preferably 0-1% by weight of the perfume composition;

(c) perfume ingredients having a ClogP>4.0, which constitute 0-25%, preferably 0-20% by weight of the perfume composition;

(d) perfume ingredients having a ClogP>5.0, which constitute 0-20%, preferably 0-15% by weight of the perfume composition; and (e) perfume ingredients having a ClogP<2.0, which constitute 0-20% and preferably 0-10% by weight of the perfume composition, and (2) 0-50%, preferably 0-40%, more preferably 0-30% and even more preferably 0-20% by weight of benefit agents other than the perfume ingredients.

The benefit agents other than perfume ingredients, which should also satisfy above conditions a) and b), are preferably selected from the group consisting of malodour counteracting agents, essential oils, aromatherapeutic materials, chemaesthetic agents vitamins, insect repellents, UV absorbers, antioxidants and agents which improve the capsule properties such as:

a) by stabilising the emulsion during capsule manufacture, b) by reducing leakage from the capsule, and c) by improving capsule hardness.

Capsules Preparation

Various patents describe compositions and processes for manufacturing aminoplast capsules in the form of a dispersion such as EP 1,246,693 A1 and U.S. Pat. No. 6,261,483 which are incorporated herein by reference. Without wishing to limit the patent in any way a typical process for preparing a capsule dispersion would include the following steps.

The preparation of an emulsion of perfume ingredients and any benefit agents or modifiers which may include emulsifying agents or emulsion stabilizers takes place under vigorous agitation.

The first step is the mixing of the above-defined emulsion with melamine-formaldehyde resin (with a melamine:formaldehyde:methanol mixture in the approximate molar ratios 1:3:2 to 1:6:4) and an emulsifier. These monomers may be precondensed or the monomers may be used directly. Some of the melamine can be replaced by urea. In these polymers, the formaldehyde may be partially etherified preferably as the methyl ethers.

Preferably, the shell is constituted of 50-100% by weight of formaldehyde-melamine, formaldehyde-melamine-urea, formaldehyde-urea condensation polymers or partially corresponding etherified formaldehyde condensation polymers, preferably as the methyl ethers.

The shell may be also constituted of 50-100% by weight of methacrylate or urethane.

Then, acid is added to the above mixture to adjust to a pH of 3.5 to 6.5 and the temperature raised to 30-45° C. Stirring is allowed to proceed until the dispersion is oil free. Any acid which has no adverse properties may be used in this process, such as for example formic acid or acetic acid.

It is particularly advantageous if the capsules are cured by heating to a temperature between 60° C. to 100° C. for several hours under moderate stirring.

It is particularly advantageous if during the early phase of curing a further addition of urea, melamine or other amines, or mixtures thereof can be made to reduce the formaldehyde concentration in the finished dispersion, and increase the wall thickness. Typically 10-30% additional melamine and/or urea can be added at this stage, and a particularly advantageous ratio is 5:1 to 1:1 melamine:urea.

Once curing is complete, the temperature is reduced to around 50° C., and the dispersion is neutralized before being adjusted to a pH around 9.5.

The final capsule dispersion as shipped should contain less than 0.1% by weight of free formaldehyde or free acetaldehyde measured by GLC or HPLC (standard methods are published by the US Environmental Protection Agency; HPLC requires derivatisation of the formaldehyde), preferably less than 100 ppm (wt/wt) and more preferably less than 10 ppm wt/wt.

It may also be advantageous to incorporate physically or chemically further materials to improve capsule deposition to substrates or to improve deposition selectivity during application or to improve the stability of the dispersion over time during storage. Such materials as cationic polymers or copolymers e.g. polyvinyl imidazole, polysaccharides based on beta 1, 4 linkages such a guar gum, and polyester copolymers such as those sold commercially as soil release polymers for detergents are examples of suitable materials to improve deposition.

Capsules of the above process will generally have a particle size within the range from 5-100 μm, preferably 5-70 μm, depending on the composition of the core material and emulsifying conditions. The capsule wall will have a thickness of 0.025 μm-1.0 μm. These parameters are important in the proper functioning of the capsules. If the capsule wall is too thin, the capsules will be too friable for subsequent shipping and handling, if too thick they might not break when required. If capsules are very small the wall material may become an uneconomically large proportion of the capsule. Very large capsules-either require thicker walls or the addition of hardeners to the core to prevent breakage in handling both of which reduces the amount of beneficial agent delivered.

The dispersion of capsules may typically contain, by weight, 2.5%-80% dispersed capsules by weight in water. Preferably the dispersion contains from 5%-70% capsules and even more preferably from 30%-70%. In some forms of the process excess water can be removed to form either a concentrated wet cake. Since the capsules are introduced to an aqueous slurry the presence of water is not deleterious and may protect the capsules during shipping.

Advantageously, the capsules are introduced in the slurry in the form of an aqueous dispersion of capsules.

Perfume

Suitable perfumes for the composition can be composed from a wide range of perfumery raw materials well known to those skilled in the art. Examples of suitable perfume ingredients are described in S. Arctander, Perfume Flavors and Chemicals. Vols. I and II, Aurthor, Montclair, N.J., and the Merck Index, 8th Edition, Merck & Co., Inc. Rahway, N.J., both being incorporated herein by reference.

It is preferable if the perfume has little or no aldehyde or amine containing raw materials. It is also preferable if more than 80% by weight of the perfume has a ClogP in the range of 1.5-4.5, more preferably in the range of ClogP 2-4.

It is also preferable that materials with a low olfactive threshold are used. A method for determing the olfactive threshold of perfume materials is given in WO 02/089862.

Particularly preferred suitable perfume compositions are under the form of an oil or waxy solid, which contain at least two perfume ingredients selected from:

a) aldehydes, including alpha beta unsaturated aldehydes, which constitute 0-20% by weight of the perfume composition;
b) primary or secondary amines constituting 0-10% by weight of the perfume composition;
c) perfume ingredients having a ClogP>4.0, which constitute 0-25% by weight of the perfume composition;
d) perfume ingredients having a ClogP>5.0, which constitute 0-20% by weight of the perfume composition; and
e) perfume ingredients having a ClogP<2.0, which constitute 0-20% by weight of the perfume composition.

In the context of this specification a "perfume composition", which is also named "fragrance" as defined below is an essential part of the invention. The term "perfume composition" means any odoriferous material or any material which acts as a malodor counteractant. A wide variety of chemicals are known for perfumery uses, induding materials such as alcohols, ketones, esters, ethers, nitriles, and the like. Without wishing to be limited, normally in most cases, the perfume compounds will have molecular weights of less than 400 mass units to ensure sufficient volatility and will not contain strongly ionizing functional groups such as sulphonates, sulphates, or quaternary ammmonium ions.

Naturally occurring plant and animal oils and exudates or oils and exudates identical to those found in the nature, comprising complex mixtures of various chemical components are also known for use as perfumes, and such materials can be used herein. Perfume compositions of the present invention can be relatively simple in their composition with a minimum of two perfume or fragrance ingredients or can comprise highly complex mixtures of natural and synthetic chemical components, chosen to provide any desired odour. Perfume ingredients are described more fully in S. Arctander, Perfume Flavors and Chemicals. Vols. I and II, Aurthor, Montclair, N.J., and the Merck Index, 8th Edition, Merck & Co., Inc. Rahway, N.J., both being incorporated herein by reference.

According to one aspect of the invention it has been found that aldehydes not only react to some extent during the preparation of the capsules but surprisingly they continue reacting over time on storage within the capsule itself to an extent which may make the fragrance olfactively unacceptable. Despite the general view that aldehydes are reactive species some aldehydes e.g. lilial, cyclamen aldehyde and hexyl cinnamic aldehyde are frequently used at quite high levels in fragrances for laundry products and are stable in these formulations. The perfume composition of the present invention preferably restrict the level of total aldehydes including alpha beta unsaturated aldehydes to less than 20% by weight, preferably less than 10% and even more preferably less than 1% of the perfume composition.

It has also been found that although an excess of water soluble amines is added at the end of the capsule manufacture to remove formaldehyde, the amines present as core components show a surprising degree of stability with the capsule. Thus, the perfume composition of the invention preferably contain less than 10% by weight, and more preferably less than 1% of primary and secondary amines.

A further aspect of the invention is that the capsule should contain more than 50% by weight, and preferably more than 60% and more preferably more than 70% and even more preferably more than 80% of perfumery ingredients. Whilst economically it would seem obvious to incorporate as much active ingredients as possible into each capsule, for many practical reasons, associated with emulsion stability, capsule integrity etc., many capsules contain other ingredients e.g. solvents, hardeners which substantially dilute the fragrance and benefit agents.

Related to the above is the realization that the fragrance no longer plays a role in deposition so the need to choose a proportion of high ClogP (Calculated logP) materials as taught in U.S. Pat. Nos. 5,652,206 and 5,500,138 for improved delivery and fragrance longevity is no longer required. Indeed, it is preferable if more volatile ingredients are selected for the fragrance to give maximum perfume impact. Thus fragrance compositions of the invention preferably contain less than 25% by weight of perfume ingredients preferably less than 20% with ClogP>4 and less than 20% with ClogP<2.

ClogP refers to the octanol/water partitioning coeffident (P) of fragrance ingredients. The octanol/water partitioning coefficient of a perfume ingredient is the ratio between its equilibrium concentrations in octanol and in water. The partitioning coefficients of perfume ingredients are more conveniently given in the form of their logarithm to the base 10, logP. Thus the perfume ingredients of this invention have logP of about 1.5 and higher preferably in the range 2.5 to 5. The logP of many perfume ingredients has been reported; for example, the Pomona92 database, available from Daylight Chemical Information Systems, Inc. (Daylight CIS), Irvine, Calif., contains many, along with citations to the original literature. However, the ClogP values reported herein are most conveniently calculated by the "CLOGP" program available within the Chemoffice Ultra Software version 9 available from CambridgeSoft Corporation, 100 CambridgePark Drive, Cambridge, Mass. 02140 USA or CambridgeSoft Corporation, 8 Signet Court, Swanns Road, Cambridge CB5 8LA UK. The ClogP values are preferably used instead of the experimental logP values in the selection of perfume ingredients which are useful in the present invention. For natural oils or extracts the composition of such oils can be determined by analysis or using the compositions published in the ESO 2000 database published by BACIS (Boelens Aroma Chemical Information Service, Groen van Prinsterlaan 21, 1272 GB Huizen, The Netherlands).

Preferably, the oil or waxy solid contains 0-1% of perfume ingredients, which are selected from:

i. the aldehydes selected from the group consisting of of amyl cinnamic aldehyde; citral (CAS 005392-40-5); hydroxy-citronellal; cinnamic aldehyde; hydroxymethylpentyl-cyclohexenecarboxaldehyde; 2-(4-tert-butylbenzyl) propionaldehyde; hexyl cinnamic aldehyde; phenyl acetaldehyde; trans-2-heptenal; 2,4-dihydroxy-3-methyl benzaldehyde; Benzaldehyde; Crotonaldehyde E (CAS 123-73-9); and furfural (CAS 98-01-1);

ii. the perfume ingredients having a ClogP>4 selected from the group consisting of of Benzyl salicylate, Benzyl cinnamate, Farnesol (CAS 4602-84-0), d-Limonene, I-Limonene, D, L-Limonene (racemic), 3-Methyl-4-(2,6,6-trimethyl-2-cyclohexen-1-yl)-3-buten-2-one, Cyclowood (CAS 13019-04-0), Polysantol (CAS 107898-54-4), iii. the perfume ingredients having a ClogP<2 selected from the group consisting of by benzyl alcohol, Cinnamyl alcohol, Coumarin; Anisyl alcohol; Acetal E71 (CAS 105-57-7), acetophenone; Sec-Butyl acetate; tert-Butyl acetate; n-Butyl acetate; iso-Butyl acetate, p-Cresol; Ethyl acetate; Ethyl propionate; Propyl acetate; Ethyl propionate; Propyl acetate; Benzyl cyanide.

Since it is inherent in the success of this invention that more fragrance will be deposited on surfaces and that the local concentration around ruptured capsules will be quite high, the composition of the capsule core must take into account the less desirable characteristics of some fragrance materials such as persistence in the environment, accumulation in aquatic organisms, and toxic, allergenic or irritant effects with some humans.

In general, since the capsules will deliver fragrance more efficiently to the surface fewer capsules and hence less fragrance is needed to achieve a desired fragrance effect, so the overall environmental load is reduced. However the greater concentration on skin or in close proximity to the skin requires additional care to formulate the core composition using only ingredients known to be safe in such a context. Among the materials known to have undesirable characteristics and therefore preferably excluded from the invention perfume compositions are nitro musks as exemplified by musk ambrette CAS 83-66-9, and musk ketone CAS 81-14-1, polycydic musks typified by Galaxolide CAS 1222-05-5 and Tonalid CAS1506-02-1, cashmeran, geranyl nitrile, safrole, estragol, methyl eugenol, halogen containing perfumery materials. Solvents especially the phthalate esters and carbitol ethers defined as $R-(OCH_2CH_2)_n-OR^1$ where n=1,2 or 3 $R=(C_1-C_7)$ alkyl or phenyl or alkyl substituted phenyl and $R^1$ is H or $(C_1-C_7)$alkyl.

Materials listed in Annex 1 of the Dangerous Substances Directive (67/548/EEC) or any of its amendments or ATPs (Adaptation to Technical Progress), or classified as R43 in their safety data sheet are optionally restricted to less than 1% of the core composition, preferably less than 0.1% by weight, more preferably below 0.001%, and even more preferably below the analytical detection limit.

In addition any materials classified as very toxic or toxic are preferably exduded from the core composition. Those fragrance ingredients alleged to be allergenic substances within the 7th amendment of the Cosmetic Directive, Directive 2003/15/EC (7th amendment to Directive 76/768/EEC) and the Detergent Regulations (2004/648/EEC) are optionally restricted to below 1% by weight, preferably below 100 ppm and more preferably below 10 ppm of the core composition. These Directives are also amended via ATPs, for example the 26th Commission Directive 2002/34/EC. The core composition is preferably formulated so as not to require any form of classification or warning phrase, especially classification Xi or Xn due to for example the presence of amounts of raw materials classified as R43 "sensitisasion by skin contact", R36 "irritating to eyes", R38 "irritating to skin" or R21 "Harmful in contact with skin" under the Dangerous Preparations Directive (99/45/EEC).

It is sometimes found that oxidation of certain raw materials can lead to the formation of peroxides, and that these peroxides have some health concerns. The SCCNFP (Scientific Committee on Cosmetic Products and Non Food Products for Consumers) in their opinion SCCNFP/0392/00, final, give a number of raw materials where there is concern. The oil or waxy solid has preferably a peroxide value of 0-20 millimoles peroxide/litre, preferably 0-10 millimoles peroxide/litre, and even more preferably 0-1 millimoles peroxide/litre. In particular it is desirable that if limonene (d-, l-, and dl-), and natural products containing substantial amounts of limonene, are used, they should have a peroxide value of less than 20 millimole peroxide per litre. The methods for measuring peroxide value are well known to those skilled in the art, and a method is published by the FMA (Fragrance Material Association).

Typical perfume compositions herein can comprise, for example, woody/earthy notes containing as perfume ingredients synthetic materials and natural extracts such as sandalwood oil, or patchouli oil and the like. The perfumes herein can be of a light, floral fragrance, e.g., rose, violet, jasmine, lily and the like. The perfume compositions herein can be formulated to provide desirable fruity odors, e.g., lime, lemon, orange, berry fruits or peach and the like.

In short, any chemically compatible material which exudes a pleasant or otherwise desirable odor can be used in the perfumed capsules herein to provide a desirable odor when applied to fabrics.

Table 1 below lists some perfume ingredients which have ClogP values, calculated using Chemoffice Ultra Version 9, between 2.0 and 5.0 and which comply with the requirements of the present invention. The values were found to be essentially identical to those obtained using Daylight C Log P (version 4.9).

TABLE 1

| Name | ClogP | CAS n° |
|---|---|---|
| Laevo carvone | 2.01 | 6485-40-1 |
| Geraniol | 2.97 | 106-24-1 |
| Cis Jasmone | 2.64 | 588-10-8 |
| Alpha Terpineol | 2.63 | 98-55-5 |
| Eugenol | 2.34 | 97-53-0 |
| Methyl cinnamate | 2.46 | 103-26-4 |
| Methyl dihydrojasmonate | 2.91 | 24851-98-7 |
| Beta methyl naphthyl ketone | 2.76 | 93-08-3 |
| Iso bornyl acetate | 4.04 | 125-12-2 |
| Carvacrol | 3.35 | 499-75-2 |
| Para cymene | 4.07 | 99-87-6 |
| Dihydromyrcenol | 3.04 | 18479-58-8 |
| Geranyl acetate | 3.91 | 105-87-3 |
| Linalyl acetate | 3.70 | 115-95-7 |
| Vertenex | 4.06 | 32210-23-4 |

Table 2 below lists examples of materials, widely used in fragrances for household products, the levels of which are restricted within the invention.

TABLE 2

| Name | ClogP | CAS n° |
|---|---|---|
| Hydroxycitronellal | 1.54 | 107-75-5 |
| Linalool | 2.75 | 78-70-6 |
| Phenyl ethyl alcohol | 1.33 | 60-12-8 |
| Coumarin | 1.41 | 91-64-5 |
| Vanillin | 1.28 | 121-33-5 |
| Citronellol | 3.25 | 106-22-9 |
| d-Limonene | 4.35 | 5989-27-5 |
| Isobutyl quinoline | 3.98 | 93-19-6 |
| Hexyl cinnamic aldehyde | 5.00 | 101-86-0 |
| Lilial | 4.10 | 80-54-6 |
| Galaxolide | 5.74 | 1222-05-5 |
| Cyclamen aldehyde | 3.83 | 103-95-7 |

In both tables the lists are not intended to be exhaustive but are included merely to clarify the definitions.

The invention also encompasses the use of odiferous materials which also act as malodor counteractants. These materials, although termed "perfume ingredients" hereinafter, may have a weak odor but can conceal or reduce any unpleasant odors. Examples of suitable malodor counteractants are disclosed in U.S. Pat. Nos. 3,102,101 and 5,554,588.

Solvents

Olfactively weak or neutral solvents may constitute up to 30% of the capsule core material by weight, preferably less than 20% by weight and more preferably less than 10% by weight. If present they will most likely have been introduced with one or more perfume ingredients. In the perfume industry it is quite common to dissolve solid perfume ingredients in a suitable solvent or to dilute powerful materials, used at low levels, with a solvent to facilitate manufacture. Typical solvents include high ClogP materials such as benzyl benzoate, isopropyl myristate, dialkyl adipates, citrate esters such as acetyl triethyl citrate or acetyl tributyl citrate or triethyl citrate or diethyl phthalate or low ClogP materials such as propylene glycol or dipropylene glycol. While these materials could affect fragrance release or emulsion properties during capsule manufacture, at the levels described such effects will be minimal. For the purpose of this patent, when solvent is present, it is considered as an "other benefit agent".

Other Benefit Agents

In the context of this specification, "other benefit agent" means any material capable of being encapsulated in the way described above and which can survive storage to deliver a benefit when used in household, personal care or cosmetic products. It is preferable if the benefit agent contains little or no aldehydes, in particular alpha, beta unsaturated aldehydes or primary or secondary amines ; as described previously, i.e. they should satisfy the requirements concerning aldehydes and amines given above for the perfume composition. Benefit agents do not have to conform to the ClogP requirements as outlined for the fragrance ingredients since it is not a necessary feature of the benefit agents that they vapourise to be effective.

Benefit agents include natural extracts or materials which have therapeutic effects as relaxants or stimulants, e.g. aromatherapy oils, whether odiferous or not. Natural oils or plant extracts which are beneficial to skin such as jojoba oil or almond oil are also benefit agents. Vitamins or vitamin derivatives such as ascorbyl palmitate (CAS 137-66-6) tocopheryl acetate (CAS 58-95-7) or retinyl palmitate (CAS 79-81-2) are also benefit agents within this definition. Materials which suppress or reduce malodour and its perception by any of the many mechanisms proposed are benefit agents such as zinc ricinoleate (CAS 13040-19-2). Materials which when added to the emulsion improve the properties of the core emulsion before encapsulation, or the properties of the capsules themselves. Materials which provide a warming or cooling effect such as described in Cosmetics and Toiletries Vol. 120 No 5 p 105 by M Erman are also benefit agents. Examples of such agents include but are not limited to: cyclohexane carboxamide N-ethyl-5-methyl-2-(1-methylethyl) known as WS3™ (CAS N° 39711-79-0); N 2,3-trimethyl-2-isopropylbutamide known as WS23[198] (CAS 51115-67-4); menthyl lactate (CAS N° 59259-38-0); (-)-menthoxypropane 1,2-diol known as cooling agent 10™ and isopulegol. Materials which act as insec repellents exemplified by ethylbutylacetylaminopropionate known as Merck's IR3535™ (CAS N° 52304-36-6); or N,N-diethyl touamide (CAS N° 134-62-3); or 1-piperidinecarboxylic acid; 2-(2-hydroxyethyl)-1-methylpropyl ester known as Bayrepel™ (CAS N° 119515-38-7); or p-menthane-3,8-diol (CAS N° 42822-86-6) or natural plant oils such as Tea Tree oil, neem oil, citronella oil, or eucalyptus oil are benefit agents. Materials which act as antimicrobial agents as exemplified by triclosan™ (CAS N° 3380-34-5), the methyl-ethyl, propyl and butyl para hydroxy benzoate esters (CAS N° 4247-02-3, 94-26-8, 94-13-3, 120-47-8, 99-76-3), 2-phenoxyethanol, 3-iodopropynyl-2-butylcarbamate (CAS N° 55406-53-6), 2-bromo-2-nitropropane-1,3 diol (CAS N° 52-51-7) and natural oils such as clove oil, pine oil, cinnamon oil, and tea tree oil are benefit agents. Materials which act as antioxidants such as butylated hydroxyl toluene or butylated hydroxyanisole or pentaerythrityl tetra- di- t-butyl hydroxyhydrocinnamate, octadecyl di t-butyl-4-hydroxyhydrocinnamate (CAS N° 2082-79-3), tetrabutyl ethylidenebisphenol (CAS N° 35958-30-6) are benefit agents. Materials which act as UV absorbers such as octyl methoxycinnamate, Benzophenone 3, butylmethoxydibenzoylmethane, or benzotriazolyl dodecyl p cresol (CAS N° 6683-19-8), bis ethylhexyloxyphenolmethoxyphenyltriazine are benefit agents. The materials listed above are intended to exemplify the benefit agents but are not intented to limit the benefit agents to this list. Mixtures of the above may also be considered as benefit agents of the invention. Thus it may be advantageous to combine UV absorbers with antioxidants to protect the fragrance ingredients or to combine an anti-fungal agent with a bacteriocide for broader antimicrobial protection. Moreover it is recognized that some materials may exhibit more than one benefit. Thus vitamin E acetate can function as an antioxidant as well as a vitamin precursor.

Slurry

The aqueous slurry used in the invention process comprises inorganic salts and at least one binding agent.

Inorganic salts suitable for spray drying are typically sodium, potassium, magnesium, calcium or aluminium salts of sulphate, carbonate, bicarbonate, citrate, silicate, which can be used alone or in any combination or ratio. Some are discussed below as inorganic builders, and others play roles such as:

- ensuring excellent powder properties and porosity (liquid carrying capacity for oily materials such as free fragrance, or nonionic surfactants) of the spray dried powder particles;
- alkalinity (e.g. carbonates);
- providing ionic strength (e.g. sulphates) to enhance performance of surfactant cleaning system.

Binding agents suitable for spray drying include nonionic, anionic, amphoteric and cationic surfactants discussed in detail below. Other suitable binding agents are organic polymers such a polycarboxylates and sodium carboxy methyl cellulose. It is particularly preferred that the binding agent has a functional benefit e.g. surfactants are also part of the cleaning system, polycarboxylate is part of the builder system etc.

The slurry is made by mixing the inorganic salts and the binding agents and the capsules with water by the methods well known by the person skilled in the art. As the slurry is very concentrated it is typically a dispersion rather than a solution (even when it contains materials which have good water solubility), and it needs to be well and continuously mixed. Any particulate matter present in the dispersion must be sufficiently small to easily pass through a spray drying nozzle without causing a blockage.

Spray Drying

Spray drying as a processing technique has and continues to find widespread use as a method for producing powders. It creates relatively porous particles which dissolve easily, even at low temperatures. Many patents and publications are available on spray drying. An overview article for detergent powders can be found in Powdered Detergents vol 71 (Surfactant Science Series) ed M Showell, ISBN 0-8247-9988-7, which includes a general overview of production methods and includes on p25, a schematic of slurry preparation and spray drying (coutesy Ballestra SPA), and Formulating Detergents and Personal Care Products. Ho Tan Tai. AOCS Press ISBN 1-893997-10-3.

Spray drying processes for forming detergent compositions are well known in the art and typically involve the steps of forming a detergent slurry, often warmed to 60-80° C. using at least in part heat of anionic surfactant neutralization (e.g. neutralization of linear alkyl benzene sulphonic acid). The slurry has typically a water content of between 30%-60% and commonly comprises a builder, a neutralized or acid-form anionic surfactant, a nonionic surfactant, a neutralizing alkali such as soda ash or sodium carbonate, an inorganic salt or salts such as sodium sulphate, water, processing aids, and organic polymers in a crutcher. The detergent slurry is pumped to the top of a spray drying tower, and sprayed from nozzles in the tower to form atomized droplets. These compositions could also be prepared by continuous slurry making. By continuous slurry making is meant a process in which components are fed continuously and substantially simultaneously to a slurry making vessel while mixed slurry is removed to the spray tower at a rate which maintains an essentially constant volume in the vessel.

Hot air is pumped through the spray drying towers such that when the atomized droplets are sprayed into the hot air, they dry into a powder as the free moisture evaporates. The spray-dried granules thus formed are then collected at the bottom of the tower. Numerous patents teach specific modifications to this basic protocol in order to better produce powders with specific properties. U.S. Pat. No. 4,269,722 teaches spray drying especially porous partides to incorporate nonionic surfactant. GB patent 1,473,201 teaches spray drying compositions containing zeolite. EP patent 1,499,703 describes the manufacture of powders having low anionic surfactant content while U.S. Pat. No. 4,900,466 describes the preparation of particles having defined pores by varying the ratio of inorganic salts in a composition with little or no surfactant but using a polymeric binder. However none of these detergent patents describe the incorporation of capsules within the slurry.

Many patents also teach spray drying for a variety of materials e.g. foodstuffs, flavourings and pharmaceutical preparations, either as a convenient means of drying these particles including aminoplast capsules or to produce highly porous particles. However none describe mixing a fragrance containing capsule with inorganic salts for spray drying to produce larger particles.

The benefits of adding the capsule dispersion to the slurry rather than by post addition are:

- there is no drying step required, as the wet capsule dispersion is added. directly to the slurry;
- no additional agglomeration step is needed to create a sufficiently large particle to remain mixed in a range of detergent powders;
- the capsule is protected within the larger detergent granule and is less liable to breakage in the subsequent processing of the detergent.

Depending on the design and operating parameters of specific spray drying towers, the characteristics of the powder particles will be affected. Typically conventional spray dried detergent powders have bulk densities of 200-550 $kgm^{-3}$ and particle sizes concentrated around 250-700 μm. In some instances it is possible to produce much finer and denser powders. These may not disperse uniformly within a detergent powder and so it is preferable if the powder is more agglomerated. This may be achieved in the spray drying tower by adding some steam to the powder or separately in a fluid bed mixer.

Examples of the composition of a range powders (often termed "blown powder" or "base powder") which can be prepared by spray drying can be found in International application WO 99/65458 which is incorporated herein by reference. This patent also teaches ingredients which can be post dosed or sprayed on to the base powder.

There are various designs and scale of spray drying equipment and accessory equipment, for example co-current, counter current air flow etc. For those skilled in the art, the selection of appropriate operating conditions and equipment will allow powders of acceptable quality to be produced using this invention on a particular spray drying tower.

Surfactant Systems

The surfactant composition for a detergent powder some components of which may optionally be incorporated in the slurry prior to spray drying may contain at least about 0.01% by weight of a surfactant selected from the group consisting of anionic, cationic, nonionic, and zwitterionic surface active agents. Preferably surfactant is present to the extent of from about 1.0% to 60%, more preferably 1.0% to about 30% by weight of the composition.

Non-limiting examples of surfactants useful herein typically at levels from about 1% to about 55%, by weight, include the conventional $C_{11}$-$C_{18}$ alkyl benzene sulfonates ("LAS") and primary, branched-chain and random $C_{10}$-$C_{20}$ alkyl sulfates ("AS"), the $C_{10}$-$C_{18}$ secondary alkyl sulfates of the formula $CH_3(CH_2)_x(CHOSO_3{}^{31}M^+)CH_3$ and $CH_3(CH_2)_y(CHOSO_3{}^{31}M^+)CH_2CH_3$ where x and (y+1) are integers of at least about 7, preferably at least about 9, and M is a water-solubilizing cation, especially sodium, unsaturated sulfates such as oleyl sulfate, the $C_{10}$-$C_{18}$ alkyl alkoxy sulfates ($AE_x$ Sulfates; especially EO 1-7 ethoxy sulfates), $C_{10}$-$C_{18}$ alkyl alkoxy carboxylates (especially the EO 1-5 ethoxycarboxyiates), the $C_{10}$-$C_{18}$ glycerol ethers, the $C_{10}$-$C_{18}$ alkyl polyglycosides and their corresponding sulfated polyglycosides, and $C_{12}$-$C_{18}$ alpha-sulfonated fatty acid esters. If desired, the conventional nonionic and amphoteric surfactants such as the $C_{12}$-$C_{18}$ alkyl ethoxylates ("AE") including the so-called narrow peaked alkyl ethoxylates and $C_6$-$C_{12}$ alkyl phenol alkoxylates (especially ethoxylates and mixed ethoxy/propoxy), $C_{12}$-$C_{18}$ betaines and sulfobetaines ("sultaines"), $C_{10}$-$C_{18}$ amine oxides, and the like, can also be induded in the overall compositions. The $C_{10}$-$C_{18}$ N-alkyl polyhydroxy fatty acid amides are highly preferred, especially the $C_{12}$-$C_{18}$ N-methylglucamides. See International application WO 92/06154. Other sugar-derived surfactants include the N-alkoxy polyhydroxy fatty acid amides, such as $C_{10}$-$C_{18}$ N-3-methoxypropyl) glucamide. The N-propyl through N-hexyl $C_{12}$-$C_{18}$ glucamides can be used for low sudsing. $C_{10}$-$C_{20}$ conventional soaps may also be used. If high foaming is desired, the branched-chain $C_{10}$-$C_{16}$ soaps may be used. Mixtures of anionic and nonionic surfactants are especially useful. Other conventional useful surfactants are described further herein and are listed in standard texts such as "Surface Active Agents and Detergents" by Schwartz, Perry & Berch incorporated herein by reference.

Anionic surfactants can be broadly described as the water-soluble salts, particularly the alkali metal salts, of organic sulfuric reaction products having in their molecular structure an alkyl radical containing from about 8 to about 22 carbon atoms and a radical selected from the group consisting of sulfonic acid and sulfuric acid ester radicals. (Included in the term alkyl is the alkyl portion of higher acyl radicals.) Important examples of the anionic synthetic detergents which can form the surfactant component of the compositions of the present invention are the sodium or potassium alkyl sulfates, especially those obtained by sulfating the higher alcohols ($C_8$-$C_{18}$ carbon atoms) produced by reducing the glycerides of tallow or coconut oil or waxy solid; sodium or potassium alkyl benzene sulfonates, in which the alkyl group contains from about 9 to about 15 carbon atoms, the alkyl radical can be a straight or branched aliphatic chain; sodium alkyl glyceryl ether sulfonates, especially those ethers of the higher alcohols derived from tallow and coconut oil or waxy solid; sodium coconut oil or waxy solid fatty acid monoglyceride sulfates and sulfonates; sodium or potassium salts of sulfuric acid ester of the reaction product of one mole of a higher fatty alcohol (e.g. tallow or coconut alcohols) and about 1 to about 10 moles of ethylene oxide; sodium or potassium salts of alkyl phenol ethylene oxide ether sulfates with about 1 to about 10 units of ethylene oxide per molecule and in which the alkyl radicals contain from 8 to 12 carbon atoms; the reaction products of fatty acids are derived from coconut oil or waxy solid sodium or potassium salts of fatty acid amides of a methyl tauride in which the fatty acids, for example, are derived from coconut oil or waxy solid and sodium or potassium beta-acetoxy- or beta-acetamido-alkanesulfbnates where the alkane has from 8 to 22 carbon atoms.

Additionally, secondary alkyl sulfates may be used by the formulator exclusively or in conjunction with other surfactant materials and the following identifies and illustrates the differences between sulfated surfactants and otherwise conventional alkyl sulfate surfactants. Non-limiting examples of such ingredients are as follows.

Conventional primary alkyl sulfates (AS), such as those illustrated above, have the general formula $ROSO_3{}^-M^+$ wherein R is typically a linear $C_8$-$C_{22}$ hydrocarbyl group and M is a water solublizing cation. Branched chain primary alkyl sulfate bsurfactants (i.e., branched-chain "PAS") having 8-20 carbon atoms are also know; see, for example, EP patent application 0,439,316.

Conventional secondary alkyl sulfate surfactants are those materials which have the sulfate moiety distributed randomly along the hydrocarbyl "backbone" of the molecule. Such materials may be depicted by the structure $CH_3(CH_2)_n(CHOSO_3{}^-M^+)(CH_2)_mCH_3$ wherein m and n are integers of 2 of greater and the sum of m+n is typically about 9 to 17, and M is a water-solublizing cation.

The aforementioned secondary alkyl sulfates are those prepared by the addition of $H_2SO_4$ to olefins. A typical synthesis using alpha olefins and sulfuric acid is disclosed in U.S. Pat. Nos. 3,234,258, 5,075,041, 5,349,101 and 5,389,277.

Water soluble salts of the higher fatty acids ie soaps are useful anionic surfactants in the composition herein. This includes alkali metal and amine or quaternary ammonium salts of higher fatty acids such as the sodium, potassium, ammonium, or alkylolammonium salts of higher fatty acids containing from about 8 to about 24 carbon atoms and preferably from about 12 to about 18 carbon atoms. The fatty acids may be saturated, often termed hardened, wholly or partially as required. Soaps can be made by direct saponification of fats or oil or waxy solids or by the neutralization of free fatty acids. Particularly useful are the sodium and/or potassium salts of the mixtures of fatty acids derived from coconut oil, palm oil and tallow. Other useful soaps are described in EP patent 1 282 678 in the section titled "fatty acids".

The preferred surfactants of the present invention are anionic surfactants, however, other surfactants useful herein are described below.

The compositions of the present invention can optionally indude at least about 0.01%, preferably at least 0.1%, more preferably from about 1% to about 30%, of an nonionic surfactant. Preferred nonionic surfactants such as $C_{12}$-$C_{18}$ alkyl ethoxylates ("AE") including the so-called narrow peaked alkyl ethoxylates and $C_6$-$C_{12}$ alkyl phenol alkoxylates (especially ethoxylates and mixed ethoxy/propoxy), block alkylene oxide condensate of $C_6$-$C_{12}$ alkyl phenols, alkylene oxide condensates of $C_8$-$C_{22}$ alkanols and ethylene oxide/propylene oxide block polymers (Pluronic™-BASF Corp.), as well as semi polar nonionics (e.g., amine oxides and phosphine oxides) can be used in the present compositions. An extensive disclosure of these types of surfactants is found in U.S. Pat. No. 3,929,678, incorporated herein by reference.

Alkylpolysaccharides such as disdosed in U.S. Pat. No. 4,565,647 (incorporated herein by reference) may also be preferred nonionic surfactants in the compositions of the invention.

Another class of nonionic surfactants comprises alkyl polyglucosides having 8 to 22, preferably 10 to 18 carbon atoms in the alkyl chain such as disclosed in U.S. Pat. No. 4,565,647. These compounds usually contain from 1 to 20, preferably from 1.1 to 5, glucoside units. Another class of nonionic surfactants comprises N-alkylglucamides.

A particularly desirable surfactant of this type for use in the compositions herein is alkyl-N-methyl glucamide.

Other sugar-derived surfactants include the N-alkoxy polyhydroxy fatty acid amides.

Another optional detersive surfactant is a cationic surfactant. The cationically charged group is an ammonium group substituted by at least one, preferably only one, hydroxyalkyl group and three alkyl groups of which one is a long alkyl chain having 12 to 20 carbon atoms and the other two alkyl substituents have 1 to 4 carbon atoms. The hydroxyalkyl preferably has from 1 to 4 carbon atoms, more preferably 2 or 3 carbon atoms, most preferably 2 carbon atoms.

Examples of suitable quaternary ammonium compounds for use as detersive surfactants are: coconut trimethyl ammonium chloride or bromide; coconut methyl dihydroxyethyl ammonium chloride or bromide; decyl triethyl ammonium chloride; decyl dimethyl hydroxyethyl ammonium chloride or bromide; $C_{12}$-$C_{15}$ dimethyl hydroxyethyl ammonium chloride or bromide; coconut dimethyl hydroxyethyl ammonium chloride or bromide; myristyl trimethyl ammonium methyl sulphate; lauryl dimethyl benzyl ammonium chloride or bromide; lauryl dimethyl (ethenoxy) ammonium chloride or bromide.

Other cationic surfactants useful herein are also described in U.S. Pat. No. 4,228,044, and in EP Patent Applications 0 000 224 and 1 254 201. Commercial examples are available as "Praepagen HY" supplied by Clariant (France), 92058 La Defense, Paris, France.

Another category of surfactants are amphoteric surfactants. These include derivatives of aliphatic quaternary ammonium, phosphonium and sulfonium compounds in which the aliphatic moieties can be straight or branched chain, and wherein one of the aliphatic substituents contains from about 8 to 18 carbon atoms and one contains an anionic water-solubilizing group. One common sub-group of amphoteric surfactants are the betaines which have the general formula: $RN^+(R_1)(R_2)CH_2)_nX^-$ wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R_1$ and $R_2$ are alkyl groups containing from 1 to about 3 carbon atoms; and n is from 1 to 6 and X is a carboxylate group.

Examples of preferred betaines are cocoamidopropyl betaine, dodecyl dimethyl betaine, cetyl dimethyl betaine, dodecyl amidopropyl dimethyl betaine, tetradecyldimethyl betaine, and tetradecylamidopropyldimethyl betaine.

Builder Systems

Detergent builders can optionally be included in the slurry for spray drying. They may also be incorporated into laundry detergent compositions to assist in controlling mineral hardness. Inorganic as well as organic builders can be used separately or in admixture. Builders are typically used in fabric laundering compositions to assist in the removal of particulate soil.

The level of builder can vary widely depending upon the type of builder and the end use of the composition. When present, the compositions will typically comprise at least about 1% builder. Formulations typically comprise from about 5% to about 80%, more typically about 10% to about 50%, by weight, of detergent builder. Lower or higher levels of builder, however, are not meant to be excluded. Examples of suitable inorganic builders are aluminosilicates having ion exchange properties, such as zeolites, for example. Various types of zeolites are suitable, especially zeolite A, X, B, P, MAP and HS in their Na form or in forms in which some of the Na has been replaced by other cations such as Li, K, Ca, Mg, or ammonium. Suitable zeolites are described, for example, in EP-A 0 038 591, EP-A 0 021 491, EP-A 0 087 035, U.S. Pat. No. 4,604,224, GB-A 2 013 259, EP-A 0 522 726, EP-A 0 384 070 and WO-A-94/24 251.

Examples of further suitable inorganic builders are amorphous or crystalline silicates, such as amorphous disilicates, crystalline disilicates, such as the sheet silicate SKS-6 (manufacturer: Hoechst). The silicates may be used in the form of their alkali metal, alkaline earth metal or ammonium salts. Preference is given to the use of Na, Li and Mg silicates.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839. NaSKS-6 is the trademark for a crystalline layered silicate marketed by Hoechst (commonly abbreviated herein as "SKS-6"). Unlike zeolite builders, the NaSKS-6 silicate builder does not contain aluminum. NaSKS-6 has the $Na_2SiO_5$ morphology form of layered silicate. It can be prepared by methods such as those described in DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the $\Delta Na_2SiO_5$ (NaSKS-6 form) is most preferred for use herein. Other silicates may also be useful such as fbr example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in DE Patent application 2,321,001.

WO 2005/052105 describes formulations which are essentially zeolite free, and which are based around carbonate and co-polymer as builder system. EP patent 0 267 043 describes yet another approach to the use of carbonate as a builder via the use of seeded calcite to promote suspended calcium carbonate.

Aluminosilicate builders are particularly useful in the present invention being of great importance in most currently marketed heavy duty granular detergent compositions. Aluminosilicate builders include those having the empirical formula:

$$[M_z(zAlO_2)y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].\ xH_2O$$

wherein x is from about 20 to about 30, especially about 27. This material is known as Zeolite A. Dehydrated zeolites (x=0-10) may also be used herein. Preferably, the aluminosilicate has a particle size of about 0.1-10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in U.S. Pat. No. 3,128,287, U.S. Pat. No. 3,635,830 and the "TMS/TDS" builders of U.S. Pat. No. 4,663,071. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance due to their availability from renewable resources and their biodegradability. Citrates can also be used in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984. Useful sucdnic acid builders include the $C_5$-$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in EP Patent Application 0 200 263.

Other suitable polycarboxylates are disclosed in U.S. Pat. Nos. 4,144,226, 3,308,067 and 3,723,322.

Fatty acids, e.g., $C_{12}$-$C_{18}$ monocarboxylic acids, can also be incorporated into the compositions alone, or in combination with the aforesaid builders, especially citrate and/or the succinate builders, to provide additional builder activity.

Other Ingredients

A wide variety of other ingredients useful in detergent compositions can be included in the compositions herein, including other active ingredients, carriers, hydrotropes, processing aids, dyes or pigments, soil release polymers.

Inorganic salts in addition to those discussed above can also be useful ingredients, in particular sodium, potassium, magnesium, calcium or aluminium salts of sulphate, carbonate, bicarbonate, citrate, silicate, which can be used alone or in any combination or ratio.

Inorganic salts not used as builders can play roles such as:

- ensuring excellent powder properties and porosity (liquid carrying capacity for oily materials such as free fragrance, or nonionic surfactants) of the spray dried powder particles;
- alkalinity (e.g. carbonates);
- providing ionic strength (e.g. sulphates) to enhance performance of surfactant cleaning system;

modifying the density of the final powder (eg post tower addition of "dense" sodium carbonate).

Examples of suitable soil release polymers and/or grayness inhibitors for laundry detergents are the following:

polyesters made from polyethylene oxides with ethylene glycol and/or propylene glycol and aromatic dicarboxylic acids or aromatic and aliphatic dicarboxylic acids;

polyesters made from polyethylene oxides which are end group-capped at one end and dihydric and/or polyhydric alcohols and dicarboxylic acid. Polyesters of this kind are known, for example, from U.S. Pat. No. 3,557,039, GB-A 1 154 730, EP-A 0 185 427, EP-A 0 241 984, EP-A 0 241 985, EP-A 0 272 033 and U.S. Pat. No. 5,142,020.

water dispersable sulphonated polyesters described in GB patent 2 307 696.

Commercially available polyester soil release polymers are supplied by Rhodia under the Repel-O-Tex trade mark, and BASF under the Sokolan SR trade mark.

Further suitable soil release polymers are amphiphilic graft polymers or copolymers of vinyl and/or acrylic esters on polyalkylene oxides (see U.S. Pat. Nos. 4,746,456 and 4,846,995, DE-A 3 711 299, U.S. Pat. Nos. 4,904,408, 4,846,994 and 4,849,126) or modified celluloses, such as methylcellulose, hydroxypropylcellulose or carboxymethylcellulose, for example.

Cotton soil release polymers are also beneficial, and modified polyethylene imines are described in U.S. Pat. No. 6,121,226. Ethoxylated polyethylene imines may be particularly useful.

Examples of softening agents which can optionally be added to the detergent powder to formulate a softening in the wash powder are clays especially the smectite clays of U.S. Pat. No. 4,062,647 as well as other softener clays known in the art, can optionally be used typically at levels from about 0.5% to about 10% by weight to provide fabric softening concurrent with cleaning from a detergent powder or tablet. Clay softeners can be used in combination with amine and cationic softeners as disclosed for example in U.S. Pat. Nos. 4,375,416 and 4,291,071. They can also be used in conjunction with flocculating agents as taught in U.S. Pat. No. 6,881,717. All the above are incorporated herein by reference.

Examples of color transfer inhibitors used are homopolymers and copolymers of vinylpyrrolidone, of vinylimidazole, of vinyloxazolidone and of 4-vinylpyridine-N-oxide, having molecular masses of from 15 000 to 100 000, and also crosslinked, finely divided polymers based on these monomers. This use of such polymers is known and disclosed for example in DE-B 2 232 353, DE-A 2 814 287, DE-A 2 814 329 and DE-A 4 316 023.

Natural polymers which can act as deposition aids or have a restoration benefit such as guar gum, locust bean gum, and xanthan gum or their derivatives as described in EP 1 141 195 and EP 1 141 196.

Suitable enzymes are proteases, lipases, amylases, and cellulases. The enzyme system may be confined to a single one of the enzymes or may comprise a combination of different enzymes.

Other optional ingredients which may be added to the spray dried base powder include enzymes, bleaches, bleach activators, bleach catalysts, photoactivators, dyes, fluorescers, fabric conditioners, clays, hydrolyzable surfactants, optical brighteners, preservatives, anti-oxidants, chelants, stabilizers, anti-shrinkage agents, anti-wrinkle agents, dispersion aids, tablet disintegrants, germiddes, fungicides, anti corrosion agents and if high foaming is desired, foam boosters such as the $C_{10}$-$C_{16}$ alkanolamides can be incorporated into the compositions, typically at 1%-10% levels. The $C_{10}$-$C_{14}$ monoethanol and diethanol amides illustrate a typical class of such foam boosters.

The detergent compositions herein will preferably be formulated such that, during use in aqueous cleaning operations, the wash water will have a pH of between about 6.5 and about 11, preferably between about 7.5 and 10.5. Laundry products are typically at pH 9-11. Techniques for controlling pH at recommended usage levels include the use of buffers, alkalis, acids, etc., and are well known to those skilled in the art.

Granular Compositions

The present invention can be used directly in low density powders (typically below 550 $kgm^{-3}$) but may also be incorporated into high density granular compositions in which the density of the granule is at least 550 $kgm^{-3}$ up to 1200 $kgm^{-3}$ more particularly from 500 to 950 $kgm^{-3}$ sometimes known as concentrated detergents or compact powders and also in laundry detergent tablets.

A typical (heavy duty) powder or granule laundry detergent of the invention, containing perfumes and benefit agents in the capsules, may have the following exemplary composition:

from 0.5 to 50% by weight, preferably from 5 to 30% by weight, of at least one anionic and/or nonionic and cationic surfactant, from 0.5 to 60% by weight, preferably from 15 to 40% by weight, of at least one inorganic builder. Most typically this would be a polyphosphate, zeolite or carbonate, from 0 to 20% by weight, preferably from 0.5 to 10% by weight, of at least one organic co-builder. Examples of co-builders are polycarboxylates, e.g. sodium citrate or polycarboxylate polymers such as the copolymer commercially named Sokalan CP5 (BASF) with is advantageously used with a zeolite.

from 0.001 to 2% by weight, preferably from 0.01 to 0.5% by weight, of capsules of the invention.

optionally from 0 to 60% by weight of at least one soluble inorganic salt. Most typically this would be a sulphate and/or carbonate (if not used as a builder).

The following ingredients may be added to a tower base powder although this is not intended to be limiting in any way to the invention. It is merely intended to describe the process of manufacturing a detergent powder and exemplify the ways in which the invention may be employed. It is also common practice to post dose nonionic surfactant(s) and builders to achieve particular powder properties or manufacturing flexibility.

Thus, the following compounds may be added to a tower base powder:

optionally from 0 to 60% by weight of at least one soluble inorganic salt. Most typically this would be a sulphate and/or carbonate, especially the sodium salts;

optionally from 0 to 35% by weight, preferably from 5 to 20% by weight, of sodium perborate or sodium percarbonate bleach and optionally a peracid or peracid precursor and stabilizing adjuncts;

optionally from 0 to 5% by weight, preferably from 0 to 1.5% by weight, of a polymeric color transfer inhibitor;

optionally from 0 to 1% by weight, preferably from 0.01 to 1.0% by weight, of protease;

optionally from 0 to 1% by weight, preferably from 0.01 to 1.0% by weight, of other laundry detergent enzymes such as lipase, cellulase, amylase, mannanase, oxidase, and peroxidase. Typically such enzymes are added as a commercially available granular cocktail of enzymes.

from 0 to 1.0% perfume which may be the same as the encapsulated fragrance but may also have a different note;

optionally from 0 to 1.5% by weight, preferably from 0.2 to 1.0% by weight, of a soil release polymer and/or graininess inhibitor or other garment care ingredients and customary auxiliaries and residual moisture to 100%.

optionally various through the wash fabric softeners especially the smectite clays which may be used in combination with amine and cationic softeners or flocculating agents.

Detergent powder compositions which exemplify many of the aspects of formulation for low and high bulk density powders and for use in different wash regimes are taught in International application WO 99/65458 which is incorporated herein by reference.

Detergent Tablets

The process of the invention may also be used to formulate detergent tablets, or tablets with a gel layer which are used in domestic laundry. Tablets contain many of the same ingredients of a detergent powder but the need to form the detergent into a tablet which will be mechanically stable yet disperse and dissolve quickly in water impose certain restrictions on the formulation as taught in International application WO 99/41353 and EP application 1 123 381. Many tablets are made from spray dried detergent powder which is mixed with other ingredients then compressed into a tablet and perhaps coated with a water soluble layer as described in U.S. Pat. No. 6,358,911, prior to packaging. Compacting powders to make tablets may cause difficulty in retaining sprayed on liquid ingredients such as nonionic surfactant or perfume or adversely affect tablet disintegration and dissolution, so the incorporation of perfume or other liquid ingredients in an encapsulated form may be especially beneficial.

Another variation in detergent compositions are fabric softeners either used as components in softening in the wash formulations or in powdered or tablet forms of fabric softeners. Compositions may include particular forms of smectite clays and cationic agents as described in U.S. Pat. No. 6,627,598 and cationic or nonionic softener molecules which may be salts of long chain tertiary amines.

Method of Use

Also provided herein is a method of delivering perfume to laundry which comprises the steps of taking the spray dried powder and adding it to a powder detergent composition or incorporating the capsules in a detergent slurry which, after spray drying provides a basic detergent powder to which other ingredients may be added either by liquid spray on as for example free fragrance or as solid granules as for example bleaching agents to formulate a commercial detergent powder and then the use of this detergent powder in a domestic clothes washing machine.

The present invention will now be illustrated with the following examples:

EXAMPLE 1

Preparation of Capsules

A 2 l cylindrical stirring vessel was fitted with an infinitely adjustable disperser having a standard commercial dispersion disk with a diameter of 50 mm.

It was charged in succession with:

400 g of Fragrance (Perfume Composition No 1 below), 69 g of a 70% solution of a methylated melamine-formaldehyde resin (molar ratio melamine: formaldehyde : methanol 1:3.9:2.4) with a Brookfield viscosity of 275 mPas and a pH of 8.5, 64 g of a 20% solution of poly-2-acrylamido-2-methylpropanesulfonic acid sodium salt (K value 123, Brookfield viscosity 770 mpas), 350 g of water, 15 g of 10% strength formic acid.

This charge was processed to a capsule dispersion by adjusting the stirring speed to a peripheral speed of approximately 20 $ms^{-1}$. The temperature was held at about 35° C.

After 60 minutes, the dispersion was oil-free; a particle size of about 5 μm had been established. The stirring speed of the dispersion disk was then reduced to a level sufficient for uniform circulation of the vessel contents.

A cure temperature of 90° C. was set, and once reached by injection of hot steam, a feed of a 27% suspension of melamine-urea (ratio 2.5:1, melamine:urea) in formic acid (to adjust pH to pH 4.5) was added to the dispersion of the preformed microcapsules with a constant mass flow rate and was metered in over the course of an hour. A total of 67 g of the suspension of melamine-urea was metered in.

A cure phase of 120 min ensues at 90° C.

After the dispersion had been cooled to about 55° C., it was neutralized with diethanolamine and adjusted to a pH of 9.5 using ammonia.

This gave a uniform aqueous capsule dispersion with a solid content of 45% capsules by weight and a viscosity of 83 mPas. Of the capsule weight around 85% is fragrance oil).

Following the same procedure, capsules were made with the perfume ingredients and optionally the other benefit agents mentioned in Tables 4 and 5, which had 45% and 40% capsules by weight respectively.

TABLE 3

Perfume composition n° 1

| Compound | CAS No. | Wt % |
|---|---|---|
| Alpha pinene | 80-56-8 | 1.0 |
| Eucalyptol | 470-82-6 | 1.0 |
| Dihydromyrcenol | 18479-58-8 | 9.0 |
| Linalool | 78-70-6 | 40.0 |
| Benzyl acetate | 140-11-4 | 20.0 |
| Ethyl benzoate | 93-89-0 | 1.0 |
| Fenchyl acetate | 13851-11-1 | 1.0 |
| Alcohol C10 | 112-30-1 | 6.0 |
| Dimethylbenzylcarbinyl acetate | 151-05-3 | 10.0 |
| Phenylethyl-2-methyl butyrate | 24817-51-4 | 1.0 |
| Hexylbenzoate | 6789-88-4 | 5.0 |
| Acetyl iso eugenol | 93-29-8 | 5.0 |

TABLE 4

Perfume composition n° 2

| Compound | CAS No | Wt % |
|---|---|---|
| Acetophenone | 98-86-2 | 5 |
| Methyl salicylate | 119-36-8 | 2 |
| Veltol Plus | 4940-11-8 | 3 |
| Koavone | 81786-73-4 | 10 |
| Phenyl acetaldehyde dimethyl acetal | 101-48-4 | 5 |
| Eugenol | 97-53-0 | 5 |
| Cashmeran | 33704-61-9 | 5 |
| Hedione | 24851-98-7 | 25 |
| Orbitone | 54464-57-2 | 25 |
| Ambretone | 37609-25-9 | 10 |

TABLE 5

| Perfume composition n° 3 | | |
|---|---|---|
| Compound | CAS No | Wt % |
| Iso amyl alcohol | 123-51-3 | 10 |
| Butyl acetate | 123-86-4 | 5 |
| Phenyl ethyl alcohol | 60-12-8 | 30 |
| Veltol Plus | 4940-11-8 | 1 |
| Cinnamic Alcohol | 104-54-1 | 9 |
| Beta Caryophyllene | 87-44-5 | 20 |
| Raspberry Ketone | 5471-51-2 | 5 |
| Exaltolide | 106-02-5 | 10 |
| Hexadecanolide | 109-29-5 | 5 |
| Ethyl Linoleate | 544-35-4 | 5 |

EXAMPLES 2-4

Spray Dried Powders

These examples describe slurry compositions for a zeolite built mixed non-ionic/anionic detergent powder such as is typical of many commercial formulations sold for use in front loading automatic washing machines in Europe. The slurry was prepared and continuously agitated, and warmed to 80° C. then spray dried in a 7 metre tower using a spinning disk for atomisation with an air inflow temperature of 220° C. and outflow temperature of 80-95° C. Examples 2 to 4 contain perfume capsules of different fragrance compositions while example A is the base powder to which free fragrance or encapsulated fragrance is added after spray drying. After a suitable storage period washes were carried out with all 3 comparative formulations to demonstrate the survival and performance of the spray dried capsules.

| | Supplier | Example 2 Wt % | Example 3 Wt % | Example 4 Wt % | Example A Wt % |
|---|---|---|---|---|---|
| 7 EO nonionic | Neodol 23-7 EO Shell | 0.8 | 0.8 | 0.8 | 0.8 |
| Zeolite A | Zeolith | 19.3 | 19.3 | 19.3 | 19.3 |
| Sodium sulphate | Aldrich | 20.1 | 20.1 | 20.1 | 20.1 |
| CP5 Sokalan | BASF | 2.9 | 2.9 | 2.9 | 2.9 |
| Sodium dodecyl benzene sulfononate | Aldrich | 7.3 | 7.3 | 7.3 | 7.3 |
| Perfume composition n° 3* | | 0.6 | | | n/a |
| Perfume composition n° 1* | | | 0.6 | | n/a |
| Perfume composition n° 2* | | | | 0.6 | n/a |
| Water | | 49 | 49 | 49 | 49.6 |
| % of encapsulated perfume present after spray drying | | 48 | 45 | 80 | |

*(added as a capsule dispersion; % water given in Example 1)

The average particle diameter of the capsules was respectively 16 μm, 18 μm and 14 μm (Malvern Instrument).

As shown above, a substantial proportion of the fragrance remains encapsulated in the powder, following slurry preparation and spray drying. Examples 2, 3, and 4 all pass the "spray dry test".

EXAMPLE 5

Slurry Survival Test

A fresh slurry was made as example A, and 10 g mixed with 0.06 g of the capsule dispersion of perfume composition N° 1. The headspace above 10 g of the fragranced slurry was sampled and analysed initially (time zero), and after 90 minutes by GC/MS.

A fresh slurry was also made as example A, and 10 g mixed with 0.02 g of free perfume composition N° 1, to provide a control of the headspace measurement, and was analysed in an identical fashion. The samples were mixed gently and then stored without further agitation at 70° C., and subsequently analysed at 70° C.

After 90 min, only 5% of the available encapsulated fragrance has been released from the capsules when compared with the free fragrance.

A further 10 g sample of the slurry A was mixed with a starch capsule containing a mint fragrance provided by Takasago Europe GmbH ("Micronplus"™).

The headspace of that sample is measured by GC/MS initially and after 90 min. The sample was stored and analysed at 70° C.

At Time zero there was substantial free fragrance measured, after 90 min, 70% of the total fragrance was released.

Aminoplast capsules show a minimum leakage during slurry survival test while the starch capsules fail the "slurry survival test".

EXAMPLE 6

The following example demonstrates that a simple slurry can be spray dried to incorporate fragrance capsule particles for subsequent dosing into a variety of powder and solid products.

The composition of Example Z was made into a slurry by mixing with water at ambient temperature in the ratio 3:7 Composition Example Z: Water, and then spray dried with a Buchi B-290 to give a base powder. An identical procedure was followed with the composition of Example 6.

| | Supplier | Example Z Wt % | Example 6 Wt % |
|---|---|---|---|
| Sodium sulphate | Aldrich | 38 | 38 |
| Nonionic 7EO | Shell - Neodol 23-7 | 1.6 | 1.6 |
| Zeolite 4A | Aldrich | 38 | 38 |
| CP5 - Sokolan (40% solids) | BASF | 6.8 | 6.8 |
| Sodium LAS | Aldrich | 14 | 14 |
| Perfume composition n° 1* | Encapsulated as in example 1 | | 1.6 |
| Water | | 1.6 | |

*(added as a capsule dispersion; % water given in Example 1)

The base powder from Example 6 had 70% encapsulated fragrance remaining after the slurry and spray drying process. The base powder from Example 6 is highly suitable as an adjunct for addition to many types of detergent powders for example for addition to non tower detergent compositions or to phosphate, carbonate or aluminosilicate based detergent powders.

EXAMPLE 7

Example 7 and comparative examples B and C show the amount of perfume remaining on a line dried cotton towelling glove (bath mitt) after washing. The glove is washed in a linitester at 40° C. for 45 minutes at an equivalent liquor to cloth ratio of 10:1 with a detergent concentration of 6.8 g/l of wash liquor, followed by 2 ambient rinses, and line drying.

In Example B the Free Perfume of composition N° 1 was dosed onto the powder of example Z. Perfume was incorporated at 0.64% by weight on the powder.

Example C is identical to example B except perfume is added via direct addition of the capsule dispersion of perfume composition N° 1 to the powder of example Z. Perfume was incorporated at 0.64% by weight on the powder (some unencapsulated fragrance is present in the capsule dispersion). Note that these capsules were not spray dried in a detergent base.

Example 7 uses the spray dried powder of example 6 comprising 0.42% fragrance (after spray drying).

The table below compares the recovery of fragrance, summed for all components, as a percentage of fragrance available

| | Example B | Example C | Example 7 |
|---|---|---|---|
| Perfume composition n° 1 available in wash | 13 mg | 13 mg | 8.6 mg (as recovered after spray drying) |
| % recovered | 3 | 13 | 15 |

Example C shows that the use of encapsulated fragrance results in higher fragrance delivery to fabric after the wash, relative to the use of free fragrance. Example 7 shows that after. preparing a slurry and spray drying, despite some fragrance loss, there is still a considerable advantage for the use of encapsulated fragrance.

EXAMPLE 8

Example 8 and comparative examples D and E show the amount of perfume remaining on a line dried cotton towelling glove (bath mitt) after washing. The glove is washed in a linitester at 40° C. for 45 minutes at an equivalent liquor to cloth ratio of 10:1 with a detergent concentration of 6.8 g/l of wash liquor, followed by 2 ambient rinses, and line drying.

In example D, the perfume composition N° 1 is dosed onto the powder of example A. Perfume was incorporated at 0.2% by weight on the powder.

Example E is similar to example B except perfume is added via direct addition of the capsule dispersion of perfume composition N° 1 to the powder of example A. Perfume was incorporated at 0.2% by weight on the powder (some unencapsulated fragrance is present in the capsule dispersion). Note that these capsules were not spray dried in a detergent base.

Example 8 uses the spray dried powder of example 3 comprising 0.2% fragrance (after spray drying).

The table below compares the recovery of fragrance, summed for all components, as a percentage of fragrance available

| | Example D | Example E | Example 8 |
|---|---|---|---|
| Perfume composition n° 1 available in wash | 4 mg | 4 mg | 4 mg (as recovered after spray-drying) |
| % recovered | 8 | 17 | 25 |

Example E shows that the use of encapsulated fragrance results in higher fragrance delivery to fabric after the wash, relative to the use of free fragrance. Example 8 shows that after preparing a slurry and spray drying there is a considerable advantage for the use of encapsulated fragrance.

EXAMPLES 9 to 13

Examples 9 to 13 demonstrate several detergent powder formulations in which the capsules can be included in the slurry prior to spray drying. Examples 9 to 11 are conventional low bulk density powders having different builders whilst example 13 is a high bulk density powder generally known as a concentrated powder. A second perfume may be post dosed to the detergent powder, and this may be the same fragrance as in the capsule but it may also have a different composition and odour.

| | Example 9 Wt % | Example 10 Wt % | Example 11 Wt % | Example 12 Wt % | Example 13 Wt % |
|---|---|---|---|---|---|
| Sodium Linear $C_{11}$-$C_{13}$ alkyl benzene sulphonate (Na-LAS) | 8.5 | 11 | 11 | 8 | 3.0 |
| Sodium $C_{12}$-$C_{15}$ alkyl 3-ethoxy sulphate (AES) | | | | 1.5 | |
| Alcohol ethoxylate Neodol 23 7EO (Shell) | 6.5 | 3.5 | 3.5 | 5 | |
| Cationic Praepagen HY | | | | 1.3 | 1.5 |
| Dequest 2060 (Monsanto) | | | | | 0.6 |
| Sodium linear $C_{12}$-$C_{18}$ Carboxylates | 2 | 1 | 1.2 | 0.3 | |
| Zeolite A24 | 19.5 | | | | |
| Zeolite A4 | | 22 | | 20 | 15.0 |
| Sokolan CP5 ex BASF polyacrylate (mw 5000) | 1.7 | 3 | 3.5 | 1 | 2.0 |
| Sodium citrate/citric acid | 2.5 | | 1.5 | 4 | 2 |
| Sodium silicate | 1.5 | | | | 4.0 |
| Sodium disilicate (SKS-6) | | 2.5 | 3.5 | 11 | |
| Sodium carbonate | 18.5 | 18.5 | 28 | 14 | 14.0 |
| Sodium sulphate | 27.5 | 10 | 23 | 4 | |
| Sodium Carboxymethyl Cellulose | 0.15 | | | 0.15 | 0.4 |
| Perfume composition n° 1 encapsulated as in example 1 | 0.26 | 0.26 | 0.26 | 0.39 | |
| Minors | | | | | |
| POST Dosed Ingredients* | | | | | |
| Na LAS | | | | | 3.0 |
| Sodium linear C16-C18 primary alcohol sulphate (Na-PAS) | | | 3.5 | 5.5 | 1.0 |
| Alcohol ethoxylate | | | | | 2.0 |
| Zeolite A | | | | | 8.0 |
| Silicone antifoam (15% active) | 1 | 0.7 | 0.7 | 1 | 5 |
| Perfume 2 | 0.15 | 0.15 | 0.15 | 0.25 | 0.3 |
| Sodium Percarbonate | 7 | | 13 | 13 | |
| Tetra-acetylethylene diamine (83%) | 1 | 4 | 3.5 | 5 | 6.0 |

-continued

| | Example 9 Wt % | Example 10 Wt % | Example 11 Wt % | Example 12 Wt % | Example 13 Wt % |
|---|---|---|---|---|---|
| Sodium perborate tetra hydrate | | 19 | | | 12.0 |
| Fluorescer Tinopal CBS-X ex Ciba (15% active) | 1 | 0.7 | 0.7 | 0.7 | |
| Dequest 2047 and 2016 ex Monsanto | 0.8 | 0.8 | 1.5 | 1.5 | |
| Enzymes (protease, lipase, cellulase, amylase) | 0.3 | 1 | 1 | 1.5 | 2.6 |
| Speckles (coloured carbonate) | | 1.5 | | | |
| Fabric care polymers (soil or waxy solid release, dye transfer etc) | 0.2 | 0.4 | 0.5 | 1 | |
| Bentonite clay | | | | | 10.0 |
| Moisture + minors | To 100 | To 100 | To 100 | To 100 | To 100 |

*Other ingredients included in the spray dried powder may also be post dosed as suits a particular manufacturing process or to achieve particular powder properties.

EXAMPLES 14 to 17

Examples 14 to 17 demonstrate a range of slurry compositions which can be spray dried into detergent powders showing different surfactant types and builder. In each case the powder was slurried to give 30-60% by weight water at 80-85° C. and spray dried with an air inlet temperatures between 200 C-350° C. and outflow temperatures of 90-100° C.

| | Example 14 Hand wash powder Wt % | Example 15 Carbonate built Zero P powder Wt % | Example 16 Zeolite built powder Wt % | Example 17 Phosphate built powder Wt % |
|---|---|---|---|---|
| Anhydrous sodium sulphate | 3.0 | 42.0 | 20.3 | 29.74 |
| Anhydrous sodium carbonate | 45.0 | 33.0 | 10.0 | 8.0 |
| Sodium silicate | 12.0 | 10.0 | 5.0 | 10.0 |
| Zeolite A4 | | | 32.0 | |
| Anhydrous sodium tripolyphosphate | | | | 22 |
| Sodium Linear C11-C13 alkyl benzene sulphonate (Na-LAS | 28.0 | | 18.0 | 9.0 |
| Alcohol ethoxylate Neodol 23-7EO ex Shell | | 2.6 | Post addition | 4.0 |
| Perfume composition n° 1 encapsulated as in example 1 | 0.26 | 0.26 | 0.26 | 0.26 |
| Moisture and minors | To 100% | To 88% | To 88% | To 93% |
| Post Dosed | Nil | 12% | 12% | 7% |

Again bleaches, bleach precursors, enzymes, certain surfactants, builders, anti-foam agents, anti-redeposition agents, fabric care polymers, fluorescers, photobleaches, and free fragrance can all be added to any of these compositions after spray drying.

EXAMPLES 18

Thermal Stability

The Capsule dispersions of perfume compositions No 1 to No 3 were directly spray dried with a Buchi B-290 to give powders which was essentially 100% dry capsules. A weighed amount of these dry capsules was placed in a temperature controlled oven at 200° C. and after 10 minutes the temperature was increased by 10° C. This procedure was repeated to 260° C. The samples were weighed after each temperature increment and in all case the final weight loss was less than 5%.

EXAMPLE 19

The following fragrance composition (perfume composition N° 4) was encapsulated as per Example 1, then a slurry prepared and spray dried as per Example 6.

| Perfume Composition N° 4 | CAS No | Wt % |
|---|---|---|
| Iso amyl alcohol* | 123-51-3 | 10 |
| Butyl acetate* | 123-86-4 | 5 |
| Phenyl ethyl alcohol* | 60-12-8 | 30 |
| Veltol Plus* | 4940-11-8 | 1 |
| Cinnamic Alcohol* | 104-54-1 | 9 |
| Beta Caryophyllene | 87-44-5 | 20 |
| Raspberry Ketone* | 5471-51-2 | 5 |
| Exaltolide | 106-02-5 | 10 |
| Hexadecanolide | 109-29-5 | 5 |

After spray drying and analysing the resultant powder, it was found that more than 70% of the fragrance components with a ClogP below 2 were lost (materials signaled with an * in the above table).

While the invention has been described in detail and with reference to specific embodiments thereof, it will be apparent to one skilled in the art that various changes and modifications can be made therein without departing from the scope thereof.

This application is based on European patent application No. 05291975.0 filed on Sep. 23, 2005, the entire contents thereof being hereby incorporated by reference.

What is claimed is:

1. A process for manufacturing a spray dried detergent powder, comprising the steps of:

(a) forming a warm, stirred aqueous slurry comprising inorganic salts, binding agent and 0.001 to 20% by weight of capsules based on the weight of spray dried powder, said capsules containing at least one benefit agent comprising perfume, and (b) spray drying the slurry to form said spray dried detergent powder while admixing with said spray dried detergent powder at least one member selected from the group consisting of a zeolite builder, phosphate builder, carbonate builder and a surfactant binding agent, wherein 1) more than 40% by weight of the benefit agent remains encapsulated 60 minutes after dispersion thereof at 70° C. in the slurry in a sealed vessel without agitation; and 2) more than 30% by weight of the benefit agent added for 15 minutes to an ambient slurry survives spray drying through a laboratory scale spray drier.

2. The process according to claim 1, wherein the capsules are core shell capsules containing in the core an oil or waxy solid, said oil or waxy solid containing less than 20% by weight of aldehydes.

3. The process according to claim 1, wherein the capsules are core shell capsules containing in the core an oil or waxy solid, said oil or waxy solid containing less than 10% by weight of primary and secondary amines.

4. The process according to claim 1, wherein the capsules are core shell capsules containing in the core an oil or waxy solid, more than 80% by weight of said oil or waxy solid having a ClogP in the range of 1.5-4.5.

5. The process according to claim 4, wherein more than 80% by weight of said oil or waxy solid has a ClogP in the range of 2-4.

6. The process according to claim 1, wherein the capsules are core shell capsules containing in the core an oil or waxy solid, said oil or waxy solid comprising:

(1) at least 50% by weight of a perfume composition, comprising two perfume ingredients selected from the group consisting of:

(a) alpha beta unsaturated aldehydes, which constitute up to 20% by weight of the perfume composition;

(b) primary or secondary amines constituting up to 10% by weight of the perfume composition;

(c) perfume ingredients having a ClogP>4.0, which constitute up to 25% by weight of the perfume composition;

(d) perfume ingredients having a ClogP>5.0, which constitute up to 20% by weight of the perfume composition; and (e) perfume ingredients having a ClogP<2.0, which constitute up to 20% by weight of the perfume composition; and (2) benefits agents other than the perfume ingredients which constitute up to 50% by weight of the perfume composition.

7. The process according to claim 6, wherein said oil or waxy solid comprises:

(1) at least 60% by weight of said perfume composition, which is a mixture of at least two perfume ingredients selected from the group consisting of:

(a) alpha beta unsaturated aldehydes, which constitute up to 10% by weight of the perfume composition;

(b) primary or secondary amines constituting up to 1% by weight of the perfume composition;

(c) perfume ingredients having a ClogP>4.0, which constitute up to 20% by weight of the perfume composition;

(d) perfume ingredients having a ClogP>5.0, which constitute up to 15% by weight of the perfume composition; and (e) perfume ingredients having a ClogP<2.0, which constitute up to 10% by weight of the perfume composition, and (2) benefit agents other than the perfume agents, which constitute up to 40% by weight of the perfume composition.

8. The process according to claim 7, wherein the mixture (1) is at least 70% by weight of said perfume composition, said alpha beta unsaturated aldehydes are up to 5% by weight of said perfume composition, and said benefit agents are up to 30% by weight of said perfume composition.

9. The process according to claim 8, wherein the mixture (1) is at least 80% by weight of said perfume composition, said alpha beta unsaturated aldehydes are up to 1% by weight of said perfume composition, and said benefit agents are up to 20% by weight of said perfume composition.

10. The process according to claim 1, wherein the capsule is a core shell capsule wherein the shell comprises formaldehyde-melamine, formaldehyde-melamine-urea, formaldehyde-urea condensation polymer or partially etherified formaldehyde condensation polymers.

11. The process according to claim 10, wherein the formaldehyde-melamine, formaldehyde-melamine-urea, formaldehyde-urea condensation polymer or partially etherified formaldehyde condensation polymer is a methyl ether.

12. The process according to claim 11, wherein the capsules have a particle size from 5 to 50 μm.

13. The process according to claim 1, wherein the capsule is a core shell capsule which is thermally stable at 250° C. for 15 minutes and contains perfume ingredients.

14. The process according to claim 13, wherein the core shell capsule further comprises at least one member selected from the group consisting of malodour counteracting agents, essential oils, aromatherapeutic materials, chemaesthetic agents, vitamins and insect repellents.

15. The process according to claim 1, wherein the capsules have a particle size of less than 300 μm.

16. The process according to claim 15, wherein the capsules have a particle size of less than 100 μm.

17. The process according to claim 1, wherein the benefit agents contain no more than 20% by weight of materials having a ClogP equal or less than 2.

18. A method for delivering perfume to a laundry, which comprises treating the laundry with a spray dried powder produced by the process according to claim 1.

* * * * *

UNITED STATES PATENT AND TRADEMARK OFFICE

CERTIFICATE OF CORRECTION

PATENT NO. : 7,538,079 B2
APPLICATION NO. : 11/525048
DATED : May 26, 2009
INVENTOR(S) : Jonathan Warr et al.

It is certified that error appears in the above-identified patent and that said Letters Patent is hereby corrected as shown below:

COLUMN 1

Line 46, “synthesis” should read --synthesize--.

COLUMN 2

Line 27, “detergent active of the type” should be deleted.

COLUMN 5

Line 59, “materials” should read --materials,--; and
Line 60, “perfume” should read --perfume,--.

COLUMN 6

Line 18, “solid waxy” should read --waxy solid--;
Line 51, “malodour” should read --malodor--; and
Line 61, “Capsules” should read --Capsule--.

COLUMN 8

Line 61, “odour.” should read --odor.--.

COLUMN 9

Line 9, “restrict” should read --restricts--.

COLUMN 11

Line 5, “sensitisasion” should read --sensitization--.

COLUMN 12

Line 66, “malodour” should read --malodor--.

UNITED STATES PATENT AND TRADEMARK OFFICE

CERTIFICATE OF CORRECTION

PATENT NO. : 7,538,079 B2
APPLICATION NO. : 11/525048
DATED : May 26, 2009
INVENTOR(S) : Jonathan Warr et al.

It is certified that error appears in the above-identified patent and that said Letters Patent is hereby corrected as shown below:

COLUMN 13

Line 10, "$WS23^{198}$" should read --WS23™--; and
Line 19, "Tea Tree" should read --tea tree--.

COLUMN 14

Line 21, "ed" should read --ed.--; and
Line 23, "p25," should read --p. 25,--.

COLUMN 15

Line 31, "scale" should read --scales--;
Line 52, "$CH_3(CH_2)_x(CHOSO_3{}^{31}M^+)CH_3$" should read --$CH_3(CH_2)_x(CHOSO_3{}^-M^+(CH_3$--;
Line 53, "$(CHOSO)_3{}^{3l}M^+)CH_2CH_3$" should read --$(CHOSO)_3{}^-M^+)CH_2CH_3$--; and
Line 57, "Sulphates;" should read --sulfates;--.

COLUMN 16

Line 58, "bsurfactants" should read --surfactants--;
Line 59, "know;" should read --known;--; and
Line 66, "of" (first occurrence) should read --or--.

COLUMN 17

Line 5, "ie" should read --i.e.--.

COLUMN 20

Line 35, "sucdinic" should read --succinic--.

COLUMN 21

Line 1, "(eg" should read --(e.g.--.

UNITED STATES PATENT AND TRADEMARK OFFICE

CERTIFICATE OF CORRECTION

PATENT NO. : 7,538,079 B2
APPLICATION NO. : 11/525048
DATED : May 26, 2009
INVENTOR(S) : Jonathan Warr et al.

It is certified that error appears in the above-identified patent and that said Letters Patent is hereby corrected as shown below:

COLUMN 23

Line 34, "are" should read --is--.

COLUMN 24

Line 3, "mpas)," should read --mPas),--.

COLUMN 27

Line 25, "available" should read --available.--; and
Line 67, "available" should read --available.--.

COLUMN 30

Line 7, "was" should read --were--.

COLUMN 31

Line 36, "benefits" should read --benefit--.

COLUMN 32

Line 36, "malodour" should read --malodor--.

Signed and Sealed this

Twentieth Day of October, 2009

David J. Kappos

David J. Kappos
*Director of the United States Patent and Trademark Office*